US010176756B2

(12) United States Patent
Hwang et al.

(10) Patent No.: US 10,176,756 B2
(45) Date of Patent: Jan. 8, 2019

(54) ORGANIC LIGHT EMITTING DISPLAY DEVICE AND ELECTRONIC DEVICE HAVING THE SAME

(71) Applicant: Samsung Display Co., Ltd., Yongin-Si, Gyeonggi-Do (KR)

(72) Inventors: Kyung-Ho Hwang, Hwaseong-si (KR); Won-Ju Shin, Cheonan-si (KR); Dong-Hwan Lee, Yongin-si (KR); Jin-Young Jeon, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 27 days.

(21) Appl. No.: 15/624,027

(22) Filed: Jun. 15, 2017

(65) Prior Publication Data

US 2018/0047335 A1 Feb. 15, 2018

(30) Foreign Application Priority Data

Aug. 9, 2016 (KR) ..... 10-2016-0101475

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/2092* (2013.01); *G09G 3/3266* (2013.01);
(Continued)

(58) Field of Classification Search
CPC ..... G09G 3/3233; G09G 2300/0861; G09G 2330/0819; G09G 2320/0233; G09G 2320/0247
See application file for complete search history.

(56) References Cited

U.S. PATENT DOCUMENTS

2002/0195968 A1* 12/2002 Sanford ..... G09G 3/325 315/169.3
2011/0025676 A1* 2/2011 Kawashima ..... G09G 3/3233 345/212
(Continued)

FOREIGN PATENT DOCUMENTS

KR 1020080095461 A 10/2008
KR 1020150116520 A 10/2015
KR 1020170049735 A 5/2017

*Primary Examiner* — Liliana Cerullo
(74) *Attorney, Agent, or Firm* — Cantor Colburn LLP

(57) ABSTRACT

An organic light emitting display device includes a display panel including pixels that includes an organic light emitting diode that emits light based on a driving current, a data driver providing a data signal to the pixels through a data line, a scan driver providing a scan signal to the pixels through a scan line, an emission control driver providing an emission control signal to the pixels through an emission control line, a first power provider providing a first high power voltage to the pixels through a first power providing line and a second power provider providing a second high power voltage to the pixels through a second power providing line and coupled to the first power provider. The second power provider includes a static current circuit that maintains the driving current having uniform value when the display panel is operated in a low frequency driving mode.

20 Claims, 5 Drawing Sheets

(51) Int. Cl.
*G09G 3/3266* (2016.01)
*G09G 3/3275* (2016.01)
*G09G 3/20* (2006.01)

(52) U.S. Cl.
CPC ... *G09G 3/3275* (2013.01); *G09G 2300/0819* (2013.01); *G09G 2300/0842* (2013.01); *G09G 2300/0861* (2013.01); *G09G 2310/0262* (2013.01); *G09G 2310/061* (2013.01); *G09G 2320/029* (2013.01); *G09G 2320/0233* (2013.01); *G09G 2320/0247* (2013.01); *G09G 2330/028* (2013.01)

(56) References Cited

U.S. PATENT DOCUMENTS

2015/0287393 A1* 10/2015 Han ..... G09G 3/325
345/213
2018/0130416 A1* 5/2018 Murakami ..... G09G 3/3233

* cited by examiner

ORGANIC LIGHT EMITTING DISPLAY DEVICE AND ELECTRONIC DEVICE HAVING THE SAME

This application claims priority under 35 USC § 119 to Korean Patent Application No. 10-2016-0101475, filed on Aug. 9, 2016, and all the benefits accruing therefrom under 35 U.S.C. § 119, the content of which in its entirety is herein incorporated by reference.

BACKGROUND

1. Field

Exemplary embodiments relate generally to an organic light emitting display device and an electronic device having the same. More particularly, exemplary embodiments of the invention relate to a pixel and a display device having the same.

2. Description of the Related Art

A flat panel display ("FPD") device is widely used as a display device of electronic devices because the FPD device is relatively lightweight and thin compared to a cathode-ray tube ("CRT") display device. Examples of the FPD device are a liquid crystal display ("LCD") device, a field emission display ("FED") device, a plasma display panel ("PDP") device, and an organic light emitting display ("OLED") device. The OLED device has been spotlighted as next-generation display devices because the OLED device has various advantages such as a wide viewing angle, a rapid response speed, a thin thickness, low power consumption, etc., for example.

Recently, various methods for decreasing power consumption of the OLED device and stably operating the OLED device are studied.

SUMMARY

Exemplary embodiments provide an organic light emitting display ("OLED") device capable of stably operating in a low frequency driving mode.

Exemplary embodiments provide an electronic device that includes a display device capable of stably operating in a low frequency driving mode.

According to an exemplary embodiment, an OLED device may include a display panel including a plurality of pixels that includes an organic light emitting diode that emits light based on a driving current, a data driver which provides a data signal to a pixel of the plurality of pixels through a data line, a scan driver which provides a scan signal to the pixel through a scan line, an emission control driver which provides an emission control signal to the pixel through an emission control line, a first power provider which provides a first high power voltage to the pixel through a first power providing line, and a second power provider which provides a second high power voltage to the pixel through a second power providing line, the second power provider being coupled to the first power provider. The second power provider may include a static current circuit that maintains the driving current having uniform value when the display panel is operated in a low frequency driving mode.

In exemplary embodiments, the second power provider may include a sensing block which detects the driving current flowing through the second power providing line and a voltage compensator which compensates a voltage level of the first high power voltage based on the driving current and output as the second high power voltage.

In exemplary embodiments, the voltage compensator may increase the voltage level of the first high power voltage when the driving current detected in the sensing block decreases.

In exemplary embodiments, the second power provider may further include a switch block that outputs the first high power voltage when the display panel is operated in a normal driving mode and outputs the second high power voltage when the display panel is operated in the low frequency driving mode.

In exemplary embodiments, the switch block may includes a first switch which determines whether to couple the first power provider and the pixel and a second switch which determines whether to couple the first power provider and the static current circuit.

In exemplary embodiments, each of the plurality of pixels may include the organic light emitting diode and a driving circuit which generates the driving current flowing through the organic light emitting diode and is coupled to the first power providing line and the second power providing line.

In exemplary embodiments, the driving circuit may include a first scan transistor and a second scan transistor which transfer the data signal provided through the data line in response to the scan signal, a driving transistor which generates the driving current in response to the data signal, a capacitor which stores the data signal, the capacitor being coupled between the first power providing line and a gate electrode of the driving transistor, a first emission control transistor coupled between the second power providing line and the driving transistor, and a second emission control transistor coupled between the driving transistor and the organic light emitting diode.

In exemplary embodiments, the driving circuit further may include a first initialization transistor which initializes the gate electrode of the driving transistor and a second initialization transistor which initializes an anode electrode of the organic light emitting diode.

In exemplary embodiments, the static current circuit may compensate the voltage level of the first high power voltage when the data signal is input.

In exemplary embodiments, the second power provider may be coupled to the first power provider or be located in the first power provider.

According to an exemplary embodiment, an electronic device may include an OLED device and a processor that controls the OLED device. The OLED device may include a display panel including a plurality of pixels that include an organic light emitting diode that emits light in response to a driving current, a data driver which provides a data signal to a pixel of the plurality of pixels through a data line, a scan driver which provides a scan signal to the pixel through a scan line, an emission control driver which provides an emission control signal to the pixel through an emission control line, a first power provider which provides a first high power voltage to the pixel through a first power providing line, and a second power provider which provides a second high power voltage to the pixel through a second power providing line, the second power provider being coupled to the first power provider. The second power provider may include a static current circuit that maintains the driving current having uniform value when the display panel is operated in a low frequency driving mode.

In exemplary embodiments, the second power provider may include a sensing block which detects the driving current flowing through the second power providing line and a voltage compensator which compensates a voltage level of the first high power voltage based on the driving current and output as the second high power voltage.

In exemplary embodiments, the voltage compensator may increase the voltage level of the first high power voltage when the driving current detected in the sensing block decreases.

In exemplary embodiments, the second power provider may further include a switch block that outputs the first high power voltage when the display panel is operated in a normal driving mode and outputs the second high power voltage when the display panel is operated in the low frequency driving mode.

In exemplary embodiments, the switch block may includes a first switch which determines whether to couple the first power provider and the pixel and a second switch which determines whether to couple the first power provider and the static current circuit.

In exemplary embodiments, each of the plurality of pixels may include the organic light emitting diode and a driving circuit which generates the driving current flowing through the organic light emitting diode and is coupled to the first power providing line and the second power providing line.

In exemplary embodiments, the driving circuit may include a first scan transistor and a second scan transistor which transfer the data signal provided through the data line in response to the scan signal, a driving transistor which generates the driving current in response to the data signal, a capacitor which stores the data signal, the capacitor being coupled between the first power providing line and a gate electrode of the driving transistor, a first emission control transistor coupled between the second power providing line and the driving transistor, and a second emission control transistor coupled between the driving transistor and the organic light emitting diode.

In exemplary embodiments, the driving circuit further may include a first initialization transistor which initializes the gate electrode of the driving transistor and a second initialization transistor which initializes an anode electrode of the organic light emitting diode.

In exemplary embodiments, the static current circuit may compensate the voltage level of the first high power voltage when the data signal is input.

In exemplary embodiments, the second power provider may be coupled to the first power provider or be located in the first power provider.

Therefore, an OLED device and an electronic device having the same may allow the driving current flowing through an organic light diode to have uniform value by controlling a voltage level of a power voltage provided to the driving transistor in a low frequency driving mode. Thus, brightness of the organic light emitting diode may be uniformly maintained in the low frequency driving mode. Therefore, a display defect such as a flicker defect may be prevented.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
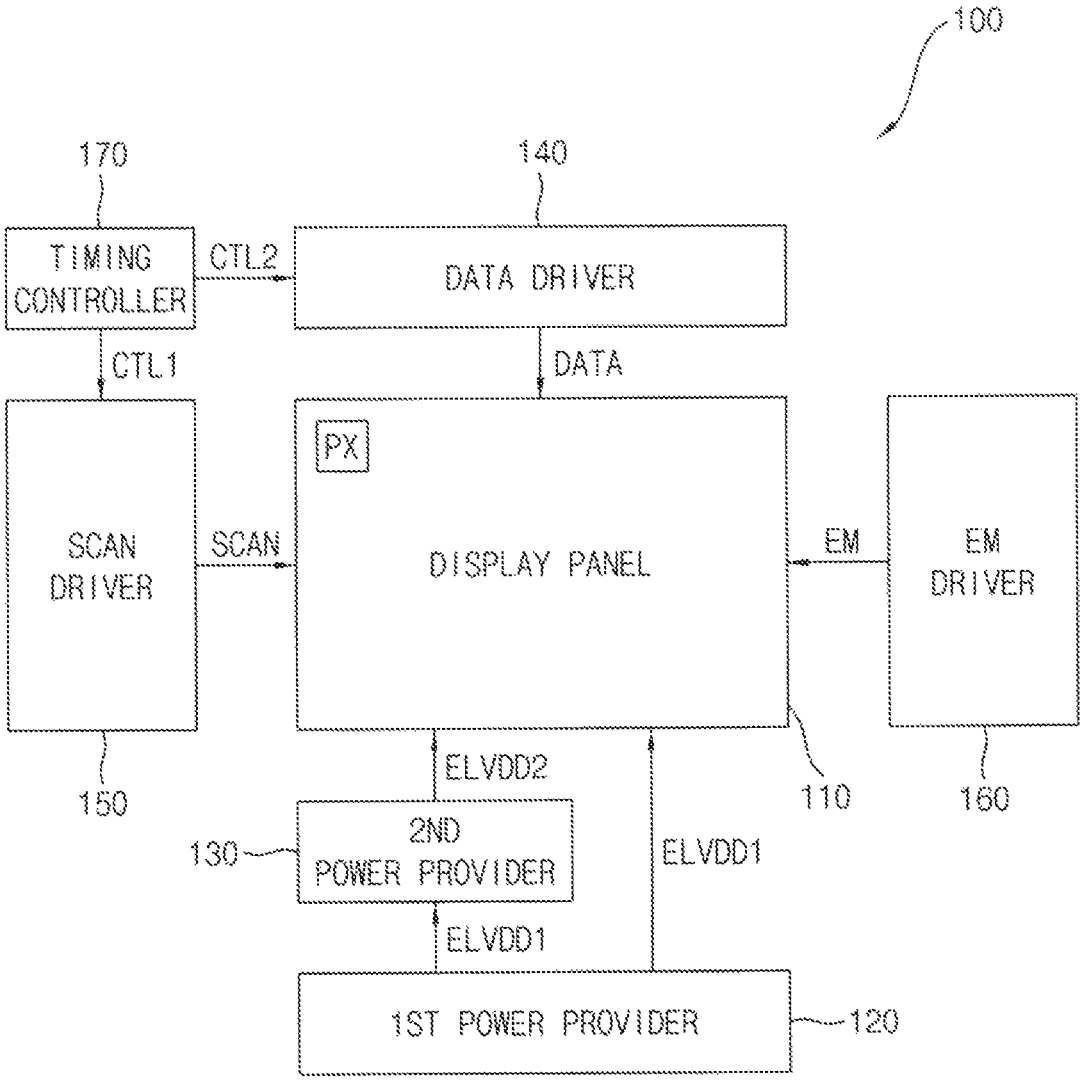
FIG. 1 is a block diagram illustrating exemplary embodiments of an organic light emitting display ("OLED") device.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating an organic light emitting display ("OLED") device according to exemplary embodiments.

Referring to FIG. 1, an OLED device 100 may include a display panel 110, a first power provider 120, a second power provider 130, a data driver 140, a scan driver 150, an emission control driver 160, and the timing controller 170.

Recently, a method that changes a driving frequency of the display device to decreasing power consumption is used. A display defect such as a flicker phenomenon may occur when the display device is operated in a low frequency driving mode. To overcome these problems, the OLED device 100 of FIG. 1 may divide a high power voltage provided to pixels into a first high power voltage ELVDD1 and a second high power voltage ELVDD2, and change a voltage level of the second high power voltage ELVDD2 based on a driving current flowing through the pixels PX in the low frequency driving mode. The OLED device 100 may be stably driven in the low frequency driving mode. Hereinafter, the OLED device 100 of FIG. 1 will be described in detail.

The display panel 110 may include the plurality of pixels PX. A plurality of first power providing lines, a plurality of second power providing lines, a plurality of data lines, a plurality of scan lines, and a plurality of emission control lines may be disposed in the display panel 110. The plurality of pixels PX may be disposed in intersection regions of the data lines and the scan lines. Each of the pixels PX may be coupled to the first power providing line, the second power providing line, the data line, the scan line, and the emission control line. Each of the pixels PX may receive the first high power voltage ELVDD1 and the second high power voltage ELVDD2, and emit light based on the driving current generated based on the data signal DATA in response to the scan signal SCAN.

Figure 4:
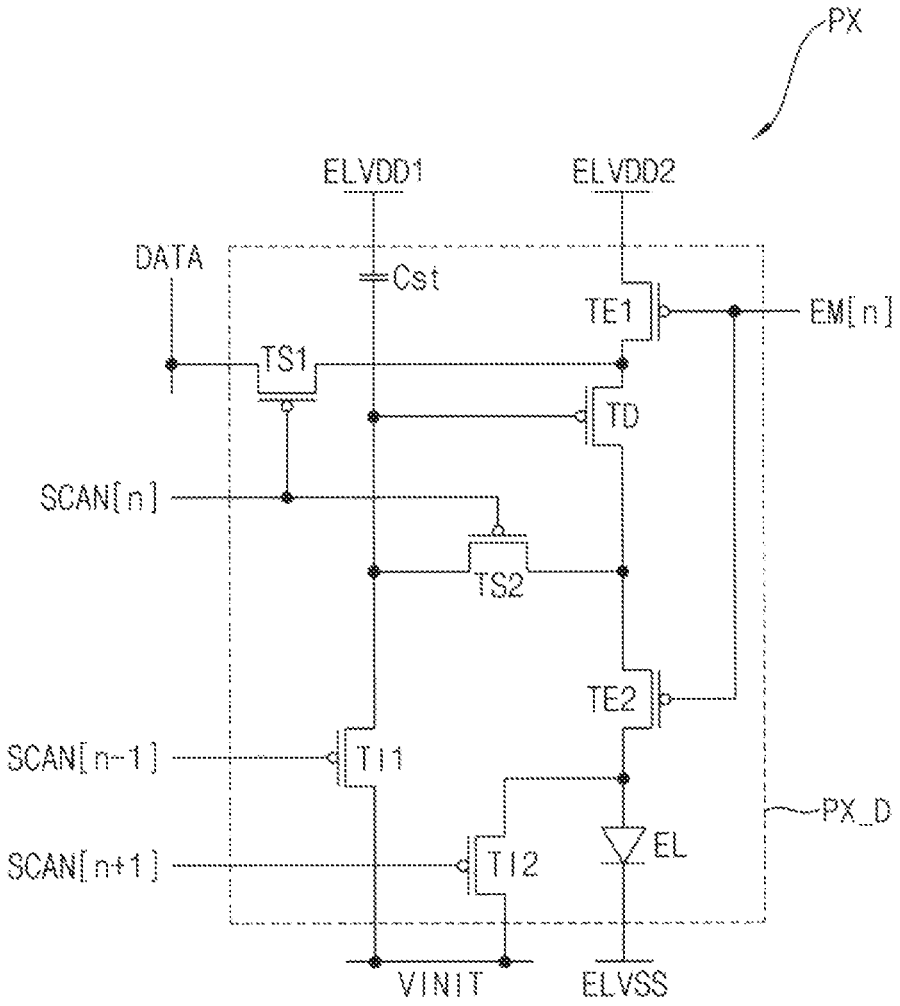
FIG. 4 is a circuit diagram illustrating an example of a pixel included in OLED device of FIG. 1.

Each of the pixels PX may include a driving circuit PX_D (refer to FIG. 4) and the organic light emitting diode EL (refer to FIG. 4). The driving circuit PX_D may be coupled to the first power providing line and the second power providing line. The driving circuit PX_D may generate the driving current flowing through the organic light emitting diode EL. The driving circuit PX_D may include a first scan transistor TS1 (refer to FIG. 4) and a second scan transistor TS2 (refer to FIG. 4) that transfer the data signal DATA through the data line in response to the scan signal SCAN, a driving transistor TD (refer to FIG. 4) that generates the driving current in response to the data signal DATA, a capacitor Cst (refer to FIG. 4) that stores the data signal DATA, a first emission control transistor TE1 (refer to FIG. 4) coupled between the second power providing line and the driving transistor TD, and the second emission control transistor TE2 (refer to FIG. 4) coupled between the driving transistor TD and the organic light emitting diode EL. Here, the capacitor Cst may be coupled to the first power providing line and receive the first high power voltage ELVDD1 provided from the first power provider 120 through the first power providing line. Further, the first emission control transistor TE1 may be coupled to the second power providing line. The first emission control transistor TE1 may receive the second high power voltage ELVDD2 provided from the second power provider 130 through the second power providing line. The driving circuit PX_D may further include a first initialization transistor that initialize a gate electrode of the driving transistor TD and a second initialization transistor that initialize an anode electrode of the organic light emitting diode EL. Hereinafter, a structure and a driving method of the pixel PX will be described in detail referring to FIG. 4.

The scan driver 150 may provide the scan signal SCAN to the pixel PX through the scan line. The data driver 140 may provide the data signal DATA to the pixel PX through the data line according to the scan signal SCAN. The emission control driver 160 may provide an emission control signal EM that determines whether to emit light to the pixels PX through the emission control line. The timing controller 170 may generate control signals CTL1, CTL2 that controls the scan driver 150, the data driver 140, and the emission control driver 160.

The first power provider 120 may provide the first high power voltage ELVDD1 to each of the pixels PX through the first power providing line and to the second power provider 130. The first high power voltage ELVDD1 may be a high power voltage (e.g., ELVDD) that drives the pixel PX.

The second power provider 130 may be coupled to the first power provider 120. The second power provider 130 may receive the first high power voltage ELVDD1 provided from the first power provider 120, compensate the first high power voltage ELVDD1, and generate the second high power voltage ELVDD2. The second power provider 130 may provide the second high power voltage ELVDD2 to each of the pixels PX through the second power providing line.

The second power provider 130 may include a static current circuit 131 (refer to FIGS. 2 and 3) that maintains the driving current having uniform value when the display panel 110 is operated in the low frequency driving mode. In an exemplary embodiment, the static current circuit 131 may include a sensing block that detects the driving current flowing through the second power providing line and a voltage compensator that compensates the voltage level of the first high power voltage ELVDD1 based on the driving current detected from the sensing block and outputs the compensated first high power voltage ELVDD1 as the second high power voltage ELVDD2, for example. Here, the voltage compensator may increase the voltage level of the first high power voltage ELVDD1 when the driving current detected from the sensing block decreases. The static current circuit 131 may compensate the voltage level of the first high power voltage ELVDD1 when the data signal DATA inputs. That is, the static current circuit 131 may compensate the first high power voltage ELVDD1 to generate the driving current having the uniform value from a first time at which the data signal DATA is input to a second time at which a next data signal DATA is input.

The second power provider 130 may further include a switch block 136 (refer to FIG. 3) that outputs the first high power voltage ELVDD1 when the display panel 110 is operated in normal driving mode and outputs the second high power voltage ELVDD2 when the display panel 110 is operated in the low frequency driving mode. The switch block 136 may include a first switch SW1 (refer to FIG. 3) that determines whether to couple the first power provider 120 and the pixel PX, and the second switch that determines whether to couple the first power provider 120 and the static current circuit 131. The first switch SW1 may turn on in the normal driving mode. The first power provider 120 and the pixel PX may be coupled when the first switch SW1 turns on. Here, the first high power voltage ELVDD1 may be output as the second high power voltage ELVDD2. That is, the second high power voltage ELVDD2 having the same voltage level with that of the first high power voltage ELVDD1 may be provided to the pixel PX in the normal driving mode. The second switch may turn on in the low frequency driving mode. The first power provider 120 and static current circuit 131 may be coupled in the low frequency driving mode. Here, the static current circuit 131 may sense the driving current flowing through the pixel PX, compensate the voltage level of the first high power voltage ELVDD1 provided from the first power provider 120 based on the driving current sensed in the sensing block, and output the first high power voltage ELVDD1 of which voltage level is compensated as the second high power voltage ELVDD2. Thus, the driving circuit PX_D of the pixel PX may generate the driving current having the uniform value based on the second high power voltage ELVDD2.

Although the second power provider 130 coupled to the first power provider 120 is illustrated in FIG. 1, a location of the second power provider 130 is not limited thereto. In an exemplary embodiment, the second power provider 130 may be located in the first power provider 120, for example.

As described above, the OLED device of FIG. 1 may divide the high power voltage provided to the pixel PX included in the display panel 110 into the first high power voltage ELVDD1 and the second high power voltage ELVDD2, and change the voltage level of the second high power voltage ELVDD2 based on the driving current flowing through the pixel PX in the low frequency driving mode. Thus, the OLED device may be stably driven in the low frequency driving mode.

Figure 2:
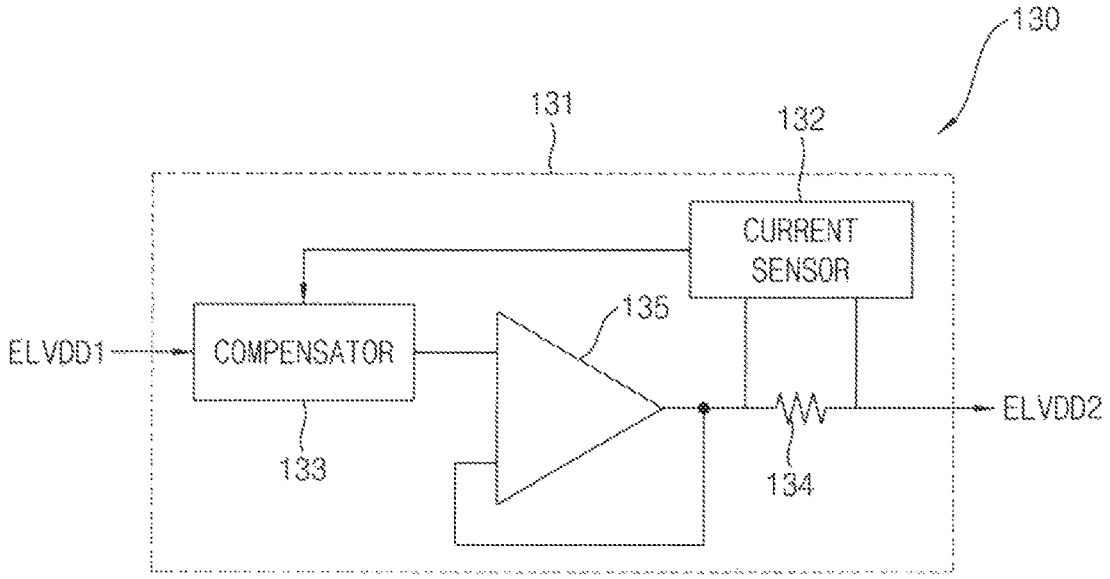
FIG. 2 is a diagram illustrating an example of a second power provider included in the OLED device of FIG. 1.

FIG. 2 is a diagram illustrating an example of a second power provider included in the OLED device of FIG. 1.

Referring to FIG. 2, the second power provider 130 may include a static current circuit 131. The static current circuit 131 may include a sensing block 132 and a voltage compensator 133. The sensing block 132 may detect the driving current flowing through the second power providing line. In an exemplary embodiment, the sensing block 132 may form a detecting resistor 134 on the second power providing line, and generate a detection voltage corresponding to the current flowing through the second power providing line, for example. The detecting resistor 134 may have a low resistance such that a voltage or a current provided to the pixels PX through the second power providing line may not be substantially affected by the detecting resistor 134.

The voltage compensator 133 may compensate the voltage level of the first high power voltage ELVDD1 based on the driving current detected in the sensing block 132. The voltage compensator 133 may output the first high power voltage ELVDD1 that is compensated as the second high power voltage ELVDD2. The voltage compensator 133 may receive the detection voltage corresponding to the driving current detected in the sensing block 132. The voltage compensator 133 may generate the second high power voltage ELVDD2 by increasing the voltage level of the first high power voltage ELVDD1 when the driving current flowing through the second power providing line decreases. In an exemplary embodiment, the voltage compensator 133 may increase the voltage level of the first high power voltage ELVDD1 as a difference of the detection voltage and a predetermined reference voltage when the voltage level of the detection voltage is lower than the reference voltage, for example.

Further, the static current circuit 131 may convert an impedance of the voltage provided from the voltage compensator 133 by implementing a voltage follower using an amplifier 135 disposed between the sensing block 132 and the voltage compensator 133.

Figure 3:
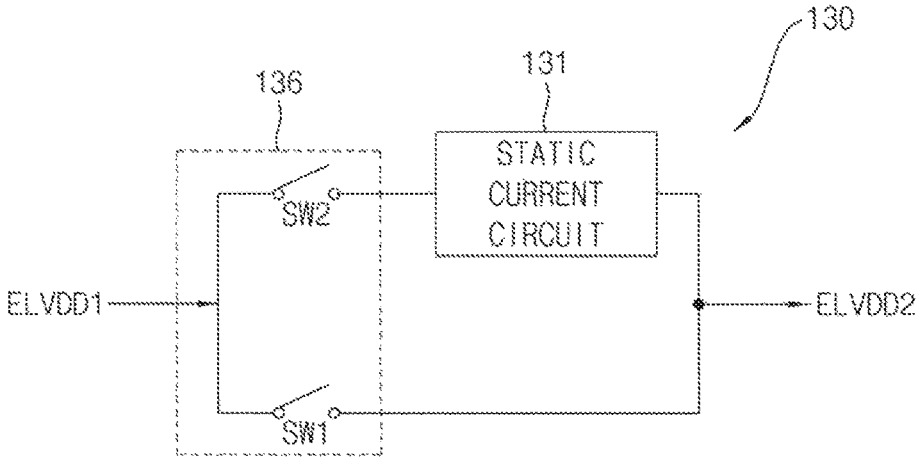
FIG. 3 is a diagram illustrating other example of a second power provider included in the OLED device of FIG. 1.

FIG. 3 is a diagram illustrating other example of a second power provider included in the OLED device of FIG. 1.

Referring to FIG. 3, the second power provider 130 may include a switch block 136, and a static circuit 131.

The switch block 136 may include a first switch SW1 and a second switch SW2. The first switch SW1 may determine whether to couple the first power provider 120 (refer to FIG. 1) and the pixels PX (refer to FIG. 1). The first switch SW1 may turn on when the display panel 110 (refer to FIG. 1) is operated in the normal driving mode. The first power provider 120 and the pixel PX may be coupled when the first switch SW1 turns on. That is, the first high power voltage ELVDD1 may bypass and output as the second high power voltage ELVDD2. The second switch SW2 may determine whether to couple the first power provider 120 and the static current circuit 131. The second switch SW2 may turn on when the display panel 110 is operated in the low frequency driving mode. The first power provider 120 and the static current circuit 131 may be coupled when the second switch SW2 turns on. The static current circuit 131 may detect the driving current flowing through the second power providing line, compensate first high power voltage ELVDD1 as the difference between the detected driving current and a predetermined reference current, and output the compensated first high power voltage ELVDD1 as the second high power voltage ELVDD2. Although the first switch SW1 and the second switch SW2 implemented as switching elements are illustrated, the first switch SW1 and the second switch SW2 are not limited thereto. In an exemplary embodiment, the first switch SW1 and the second switch SW2 may be implemented as a switching transistor that determine to couple the first power provider 120 and the pixel PX to each other or the first power provider 120 and the static current circuit 131 to each other, for example. In an exemplary embodiment, the first switch SW1 and the second switch SW2 may be implemented as a p-channel metal oxide-semiconductor ("PMOS") transistor, for example. In another exemplary embodiment, the first switch SW1 and the second switch SW2 may be implemented as an n-channel metal oxide-semiconductor ("NMOS") transistor, for example.

Figure 5:
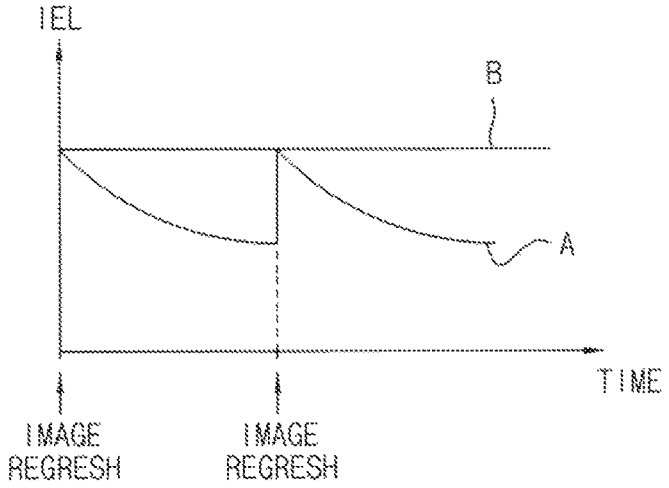
FIG. 5 is a graph illustrating for describing an operation of the pixel of FIG. 4.

FIG. 4 is a circuit diagram illustrating an example of a pixel included in OLED device of FIG. 1 and FIG. 5 is a graph illustrating for describing an operation of the pixel of FIG. 4.

Referring to FIG. 4, the pixel PX may include an organic light emitting diode EL and a driving circuit PX_D.

The organic light emitting diode EL may emit light based on a driving current. The organic light emitting diode EL may have an anode electrode coupled to a second electrode of a second emission control transistor TE2 and a cathode electrode coupled to a third power providing line. Here, a low power voltage ELVSS may be provided through the third power providing line. The organic light emitting diode EL may emit light based on the driving current provided through a driving transistor TD.

The driving circuit PX_D may include a first scan transistor TS1, a second scan transistor TS2, the driving transistor TD, a capacitor Cst, a first emission control transistor TE1, and a second emission transistor TE2.

The first scan transistor TS1 and the second scan transistor TS2 may provide a data signal DATA to the capacitor Cst through a data line in response to a scan signal SCAN[n]. The first scan transistor TS1 may have a gate electrode coupled to an nth scan line, a first electrode coupled to the data line, and a second electrode coupled to a first electrode of the driving transistor TD. The second scan transistor TS2 may have a gate electrode coupled to the nth scan line, a first electrode coupled to a second electrode of the capacitor Cst, and a second electrode coupled to a second electrode of the driving transistor TD. The first scan transistor TS1 and the second scan transistor TS2 may turn on in response to the scan signal SCAN[n] provided through the nth scan line. The data signal DATA provided to the first electrode of the first scan transistor TS1 may be provided to the capacitor Cst through the second scan transistor TS2.

The capacitor Cst may be coupled between a first power providing line and the gate electrode of the driving transistor TD. The capacitor Cst may store the data signal DATA. The capacitor Cst may store the data signal DATA provided through the first scan transistor TS1 and the second scan transistor TS2 during a scan period in which the scan signal SCAN[n] is provided. The capacitor Cst may have a first electrode coupled to the first power providing line and a second electrode coupled to the first electrode of the second scan transistor TS2. The data signal DATA stored in the capacitor Cst may be provided to the gate electrode of the driving transistor TD.

The driving transistor TD may generate the driving current flowing through the organic light emitting diode EL in response to the data signal DATA. The driving transistor TD may have a gate electrode coupled to the second electrode of the capacitor Cst, a first electrode coupled to the second electrode of the first emission control transistor TE1, and a second electrode coupled to a first electrode of the second emission control transistor TE2. The driving transistor TD may generate the driving current corresponding to the data signal DATA provided from the capacitor Cst. Referring to FIG. 5, the driving current IEL may decrease to A by a hysteresis property of the driving transistor TD in the low frequency driving mode. The second power provider 130 of FIG. 1 may sense the driving current flowing through the second power providing line, compensate the first high power voltage ELVDD1 as the voltage corresponding to the detected driving current, and provide the compensated voltage to the first electrode of the driving transistor TD as the second high power voltage ELVDD2. Thus, the pixel PX of FIG. 4 may generate the driving current having uniform value B regardless of the hysteresis property of the driving transistor as illustrated in FIG. 5.

The first emission control transistor TE1 may be coupled between the second power providing line and the driving transistor TD, and the second emission control transistor TE2 may be coupled between the driving transistor TD and the organic light emitting diode EL. The first emission control transistor TE1 and the second emission control transistor TE2 may control the organic light emitting diode EL. The first emission control transistor TE1 may have a gate electrode coupled to an nth emission control line, a first electrode coupled to the second power providing line, and a second electrode coupled to the first electrode of the driving transistor TD. The second emission control transistor TE2 may have a gate electrode coupled to the nth emission control line, a first electrode coupled to the second electrode of the driving transistor TD, and the second electrode coupled to the anode electrode of the organic light emitting diode EL. The first emission control transistor TE1 and the second emission control transistor TE2 may turn on in response to the emission control signal EM[n] through the nth emission control line. The second high power voltage ELVDD2 may be provided to the driving transistor TD and the driving current generated in the driving transistor TD may flow through the organic light emitting diode EL when the first emission control transistor TD and the second emission control transistor TE2 turn on. Thus, the organic light emitting diode EL may emit light while the first emission control transistor TE1 and the second emission control transistor TE2 turn on.

The pixel PX of FIG. 4 may further include a first initialization transistor TI1 and a second initialization transistor TI2. The first initialization transistor TI1 may initialize the gate electrode of the driving transistor TD. The first initialization transistor TI1 may have a gate electrode coupled to an (n−1)th scan line, a first electrode coupled to the gate electrode of the driving transistor TD, and a second electrode coupled to an initialization voltage providing line. The first initialization transistor TI1 may turn on in response to the scan signal SCAN[n−1] provided through the (n−1)th scan line. The initialization voltage VINIT may be provided to the gate electrode of the driving transistor TD through the initialization voltage providing line when the first initialization transistor TI1 turns on. Thus, the driving current having the same value may be generated in all the pixels regardless of difference of threshold voltages of the driving transistors TD. The second initialization transistor TI2 may initialize the anode electrode of the organic light emitting diode EL. The second initialization transistor TI2 may have a gate electrode coupled to an (n+1)th scan line, a first electrode coupled to the anode electrode of the organic light emitting diode EL, and a second electrode coupled to the initialization voltage providing line. The second initialization transistor TI2 may turn on in response to the scan signal SCAN[n+1] provided through the (n+1)th scan line. The initialization voltage VINIT may be provided to the anode electrode of the organic light emitting diode EL through the initialization voltage providing line when the second initialization transistor TI2 turns on. Thus, the anode electrode of the organic light emitting diode EL of all pixels PX may have the same voltage level.

Figure 6:
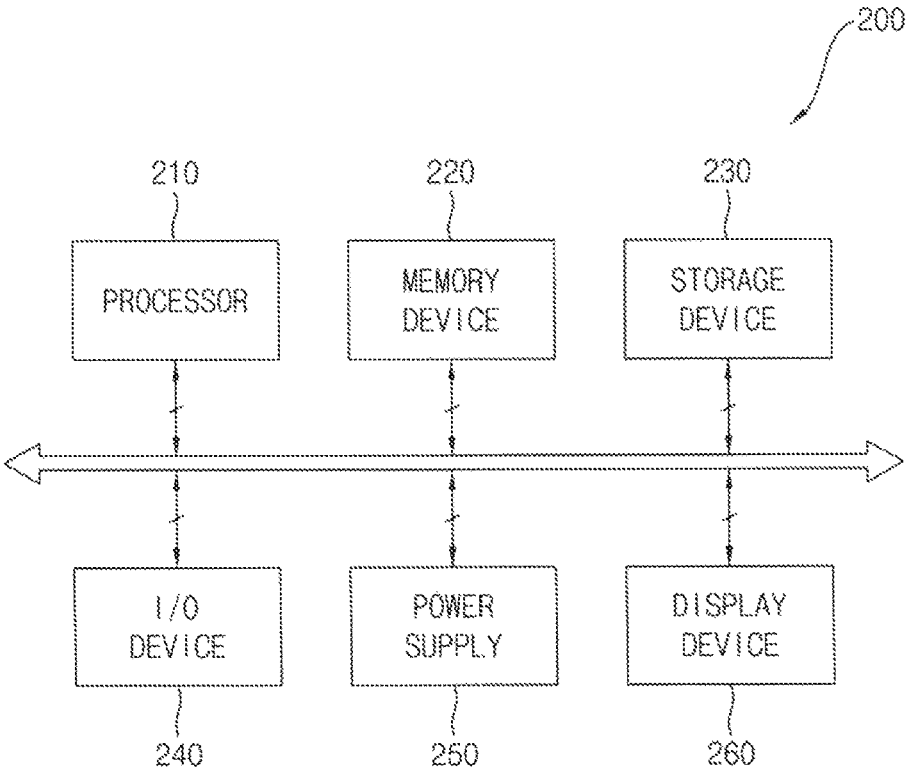
FIG. 6 is a block diagram illustrating exemplary embodiments of an electronic device.
Figure 7:
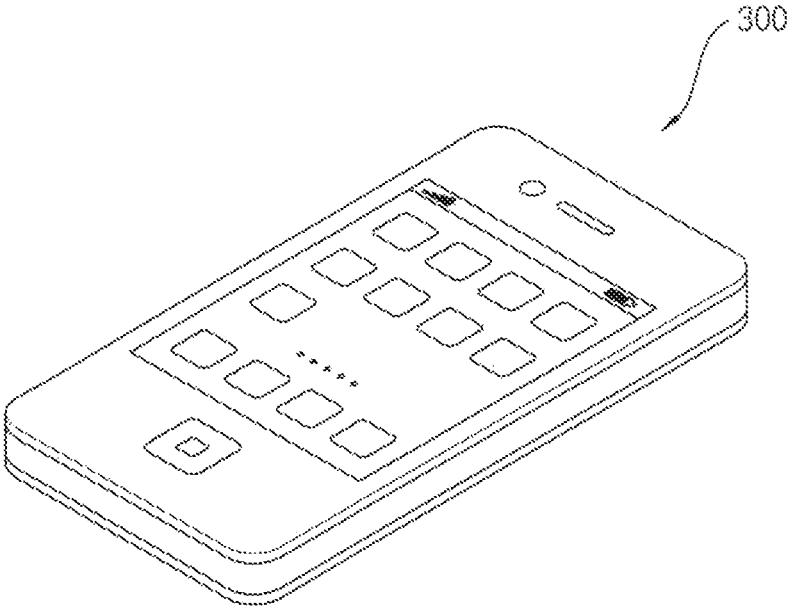
FIG. 7 is a diagram illustrating an exemplary embodiment in which the electronic device of FIG. 6 is implemented as a smart phone.

FIG. 6 is a block diagram illustrating an electronic device according to exemplary embodiments and FIG. 7 is a diagram illustrating an exemplary embodiment in which the electronic device of FIG. 6 is implemented as a smart phone.

Referring to FIGS. 6 and 7, an electronic device 200 may include a processor 210, a memory device 220, a storage device 230, an input/output ("I/O") device 240, a power supply 250, and a display device 260. Here, the display device 260 may correspond to the display device 100 of FIG. 1. In exemplary embodiments, the electronic device 200 may further include a plurality of ports for communicating a video card, a sound card, a memory card, a universal serial bus ("USB") device, or other electronic device, etc., for example. Although it is illustrated in FIG. 7 that the electronic device 200 is implemented as a smart phone 300, a kind of the electronic device 200 is not limited thereto.

The processor 210 may perform various computing functions. In an exemplary embodiment, the processor 210 may be a micro processor, a central processing unit ("CPU"), etc., for example. In an exemplary embodiment, the processor 210 may be coupled to other components via an address bus, a control bus, a data bus, etc., for example. In an exemplary embodiment, the processor 210 may be coupled to an extended bus such as surrounded component interconnect ("PCI") bus, for example. The memory device 220 may store data for operations of the electronic device 200. In an exemplary embodiment, the memory device 220 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc., for example. In an exemplary embodiment, the storage device 230 may be a solid stage drive ("SSD") device, a hard disk drive ("HDD") device, a CD-ROM device, etc., for example.

In an exemplary embodiment, the I/O device 240 may be an input device such as a keyboard, a keypad, a touchpad, a touch-screen, a mouse, etc., and an output device such as a printer, a speaker, etc. In another exemplary embodiment, the display device 260 may be included in the I/O device 240, for example. The power supply 250 may provide a power for operations of the electronic device 200. The display device 260 may communicate with other components via the buses or other communication links. As described above, the display device 260 may include a display panel, a first power provider, a second power provider, a data driver, a scan driver, an emission control driver, and a timing controller. The display panel may include a plurality of pixels coupled to a first power providing line a second power providing line, a data line, a scan line, and an emission control line. Each of the pixels may receive a first high power voltage and a second high power voltage, and emit light by a driving current generated based on a data signal input in response to the scan signal. The first power provider may provide the first high power voltage to each of the pixels through the first power providing line. The second power provider may receive the first high power voltage from the first power provider and generate the second high power voltage by compensating the first high power voltage. The second power provider may provide the second high power voltage each of the pixels through the second power providing line. The second power provider may include a static current circuit that allow the driving current to have uniform value when the display panel is operated in a low frequency driving mode. The static current circuit may compensate the voltage level of the first high power voltage to allow the driving current to have uniform value from a first time at which the data signal is input to a second time at which the next data signal is input. The second power provider may further include a switch block that output the first high power voltage when the display panel is operated in a normal driving mode and output the second high power voltage when the display panel is operated in the low frequency driving mode. The scan driver may provide the scan signal to the pixels through the scan line. The data driver may provide the data signal to the pixels through the data line in response to the scan signal. The emission control driver may provide the emission control signal that controls the organic light emitting diode to the pixel through the emission control line. The timing controller may generate the control signals that control scan driver, the data driver, and the emission control driver.

As described above, the electronic device 200 of FIG. 6 may include the display device 260 that divides the high power voltage provided to the pixel into the first high power voltage and the second high power voltage and changes the voltage level of the second high power voltage based on the driving current flow through the pixels in the low frequency driving mode. Thus, the display device 260 may be stably operated in the low frequency driving mode.

The invention may be applied to a display device and an electronic device having the display device. In an exemplary embodiment, the invention may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. An organic light emitting display device comprising:

a display panel including a plurality of pixels which includes an organic light emitting diode which emits light based on a driving current;

a data driver which provides a data signal to a pixel of the plurality of pixels through a data line;

a scan driver which provides a scan signal to the pixel through a scan line;

an emission control driver which provides an emission control signal to the pixel through an emission control line;

a first power provider which provides a first high power voltage to the pixel through a first power providing line; and a second power provider which provides a second high power voltage to the pixel through a second power providing line separate from the first power providing line, is coupled to the first power provider, and includes a static current circuit which maintains the driving current having uniform value when the display panel is operated in a low frequency driving mode.

2. The organic light emitting display device of claim 1, wherein the second power provider includes:

a sensing block which detects the driving current flowing through the second power providing line; and a voltage compensator which compensates a voltage level of the first high power voltage based on the driving current and output as the second high power voltage.

3. The organic light emitting display device of claim 2, wherein the voltage compensator increases the voltage level of the first high power voltage when the driving current detected in the sensing block decreases.

4. The organic light emitting display device of claim 1, wherein the second power provider further includes a switch block which outputs the first high power voltage when the display panel is operated in a normal driving mode and outputs the second high power voltage when the display panel is operated in the low frequency driving mode.

5. The organic light emitting display device of claim 4, wherein the switch block includes:

a first switch which determines whether to couple the first power provider and the pixel; and a second switch which determines whether to couple the first power provider and the static current circuit.

6. The organic light emitting display device of claim 1, wherein each of the plurality of pixels includes:

the organic light emitting diode; and a driving circuit which generates the driving current flowing through the organic light emitting diode and is coupled to the first power providing line and the second power providing line.

7. The organic light emitting display device of claim 6, wherein the driving circuit includes:

a first scan transistor and a second scan transistor which transfer the data signal provided through the data line in response to the scan signal;

a driving transistor which generates the driving current in response to the data signal;

a capacitor which stores the data signal, the capacitor being coupled between the first power providing line and a gate electrode of the driving transistor;

a first emission control transistor coupled between the second power providing line and the driving transistor; and a second emission control transistor coupled between the driving transistor and the organic light emitting diode.

8. The organic light emitting display device of claim 7, wherein the driving circuit further includes:

a first initialization transistor which initializes the gate electrode of the driving transistor; and a second initialization transistor which initializes an anode electrode of the organic light emitting diode.

9. The organic light emitting display device of claim 1, wherein the static current circuit compensates a voltage level of the first high power voltage when the data signal is input.

10. The organic light emitting display device of claim 1, wherein the second power provider is coupled to the first power provider or is located in the first power provider.

11. An electronic device includes an organic light emitting display device and a processor which controls the organic light emitting display device, the organic light emitting display device comprising:

a display panel including a plurality of pixels which includes an organic light emitting diode which emits light in response to a driving current;

a data driver which provides a data signal to a pixel of the plurality of pixels through a data line;

a scan driver which provides a scan signal to the pixel through a scan line;

an emission control driver which provides an emission control signal to the pixel through an emission control line;

a first power provider which provides a first high power voltage to the pixel through a first power providing line; and a second power provider which provides a second high power voltage to the pixel through a second power providing line separate from the first power providing line, the second power provider being coupled to the first power provider, wherein the second power provider includes a static current circuit which maintains the driving current having uniform value when the display panel is operated in a low frequency driving mode.

12. The electronic device of claim 11, wherein the second power provider includes:

a sensing block which detects the driving current flowing through the second power providing line; and a voltage compensator which compensates a voltage level of the first high power voltage based on the driving current and output as the second high power voltage.

13. The electronic device of claim 12, wherein the voltage compensator increases the voltage level of the first high power voltage when the driving current detected in the sensing block decreases.

14. The electronic device of claim 11, wherein the second power provider may further include a switch block which outputs the first high power voltage when the display panel is operated in a normal driving mode and outputs the second high power voltage when the display panel is operated in the low frequency driving mode.

15. The electronic device of claim 14, wherein the switch block includes:

a first switch which determines whether to couple the first power provider and the pixel; and a second switch which determines whether to couple the first power provider and the static current circuit.

16. The electronic device of claim 11, wherein each of the plurality of pixels includes:

the organic light emitting diode; and a driving circuit which generates the driving current flowing through the organic light emitting diode and is coupled to the first power providing line and the second power providing line.

17. The electronic device of claim 16, wherein the driving circuit includes:

a first scan transistor and a second scan transistor which transfer the data signal provided through the data line in response to the scan signal;

a driving transistor which generates the driving current in response to the data signal;

a capacitor which stores the data signal, the capacitor being coupled between the first power providing line and a gate electrode of the driving transistor;

a first emission control transistor coupled between the second power providing line and the driving transistor; and a second emission control transistor coupled between the driving transistor and the organic light emitting diode.

18. The electronic device of claim 17, wherein the driving circuit further includes:

a first initialization transistor which initializes the gate electrode of the driving transistor; and a second initialization transistor which initializes an anode electrode of the organic light emitting diode.

19. The electronic device of claim 11, wherein the static current circuit compensate a voltage level of the first high power voltage when the data signal inputs.

20. The electronic device of claim 11, wherein the second power provider is coupled to the first power provider or is located in the first power provider.

* * * * *